US011596269B2

(12) United States Patent
Patterson

(10) Patent No.: US 11,596,269 B2
(45) Date of Patent: Mar. 7, 2023

(54) LIQUID DISPENSING CONTAINER AND HOUSING ASSEMBLY

(71) Applicant: Kerrick Patterson, Apple Valley, CA (US)

(72) Inventor: Kerrick Patterson, Apple Valley, CA (US)

( * ) Notice: Subject to any disclaimer, the term of this patent is extended or adjusted under 35 U.S.C. 154(b) by 0 days.

(21) Appl. No.: 17/154,490

(22) Filed: Jan. 21, 2021

(65) Prior Publication Data

US 2021/0289993 A1 Sep. 23, 2021

Related U.S. Application Data

(60) Provisional application No. 62/963,744, filed on Jan. 21, 2020.

(51) Int. Cl.
*A47K 5/12* (2006.01)

(52) U.S. Cl.
CPC ..... *A47K 5/1202* (2013.01); *A47K 2201/02* (2013.01)

(58) Field of Classification Search
CPC ..... A47K 5/1202; A47K 2201/02; A47K 5/1207; G01F 11/025
See application file for complete search history.

(56) References Cited

U.S. PATENT DOCUMENTS 2,004,295 A 6/1935 Rothchild et al.
3,430,817 A 3/1969 Falkenberg
3,827,601 A * 8/1974 Magrath ..... A61M 5/162 222/324
4,036,406 A * 7/1977 Jespersen ..... G01F 11/025 137/853
4,360,130 A * 11/1982 Nishimura ..... A47K 5/1204 222/153.09
5,102,010 A * 4/1992 Osgar ..... B65D 47/36 222/541.9
5,105,992 A * 4/1992 Fender ..... A47K 5/1215 222/325

(Continued)

FOREIGN PATENT DOCUMENTS

JP 2010013103 1/2010
KR 20130009283 1/2013

(Continued)

*Primary Examiner* — Bob Zadeh
(74) *Attorney, Agent, or Firm* — John Rizvi, P.A. The Patent Professor

(57) ABSTRACT

A liquid dispensing container and housing assembly for housing and concealing a container in an inverted position to dispense substantially all of a liquid, such as, hand soap, shampoo, hair conditioner, hand sanitizer, from the inverted container in a controlled manner. The dispensing container includes a first housing portion securely holding the inverted container, a second housing portion, a container socket for receiving and holding necks of inverted containers, and a pump assembly in fluid communication with the container socket, via a delivery conduit, and including a delivery spout. The container socket includes a socket seal for tightly engaging and sealing the exterior surface of necks of inverted containers. In one embodiment, the delivery conduit includes a 90-degree conduit, or a meandering conduit to provide a first housing portion having a smaller size to accommodate smaller sized containers.

17 Claims, 14 Drawing Sheets

(56) References Cited

U.S. PATENT DOCUMENTS

| | | | | |
|---|---|---|---|---|
| 5,351,860 | A * | 10/1994 | Gotoh | B67B 7/26 222/89 |
| 5,732,853 | A * | 3/1998 | Ganzeboom | B65D 75/70 222/89 |
| 5,934,510 | A | 8/1999 | Anderson | |
| 6,065,649 | A | 5/2000 | Scoggins | |
| 8,308,027 | B2 | 11/2012 | Law et al. | |
| 8,505,776 | B2 | 8/2013 | Criswell et al. | |
| 9,439,551 | B1 | 9/2016 | Atkinson et al. | |
| 9,611,839 | B2 | 4/2017 | McNulty et al. | |
| 9,884,336 | B2 | 2/2018 | Hoefte et al. | |
| 10,022,023 | B2 | 7/2018 | Santoro et al. | |
| 10,259,669 | B2 | 4/2019 | Showalter | |
| 2002/0125271 | A1* | 9/2002 | Zeitlin | A47K 5/1204 222/1 |
| 2004/0217197 | A1* | 11/2004 | Mazooji | A47K 3/281 239/302 |
| 2007/0080177 | A1 | 4/2007 | Hatton et al. | |
| 2007/0194053 | A1 | 8/2007 | Ophardt | |
| 2009/0212072 | A1 | 8/2009 | Fenton | |
| 2011/0180619 | A1 | 7/2011 | Konishi et al. | |
| 2014/0021221 | A1 | 1/2014 | Derby et al. | |
| 2014/0261799 | A1 | 9/2014 | Ciavarella et al. | |
| 2018/0132671 | A1 | 5/2018 | Callicoat | |
| 2020/0197966 | A1* | 6/2020 | Marshall | B05B 11/3087 |
| 2021/0289993 | A1* | 9/2021 | Patterson | A47K 5/1202 |

FOREIGN PATENT DOCUMENTS

| | | | |
|---|---|---|---|
| KR | 200488586 | 2/2019 | |
| KR | 20190054699 | 5/2019 | |
| WO | WO-2019010393 A1 * | 1/2019 | A47K 5/1207 |

* cited by examiner

LIQUID DISPENSING CONTAINER AND HOUSING ASSEMBLY

CROSS-REFERENCE TO RELATED APPLICATION

This application claims the benefit of U.S. Provisional Patent Application No. 62/963,744, filed on Jan. 21, 2020, which is incorporated herein by reference in its entirety.

FIELD OF THE INVENTION

The present invention relates generally to dispensers, and more particularly, to a liquid dispensing assembly suitable for housing and concealing an inverted container with liquid to facilitate substantially complete dispensing of the liquid from the inverted container where the liquid includes, for example, hand sanitizer, hand soap, shampoo, oil, gel, dish soap, hair conditioner, and body wash.

BACKGROUND OF THE INVENTION

Many liquid dispensing containers are designed to hold and dispense a variety of liquids including, for example, hand sanitizers, hand soaps, shampoos, hair conditioners, or body wash. In some applications, liquid is dispensed from such containers, via a pump that is activated by users to provide controlled dispensing of liquid, or alternatively, users invert the containers by hand to dispense liquid from the container by gravity if no pump is provided. The liquid dispensing containers are often mounted on vertical surfaces such as on a wall in public restrooms, or are disposed on kitchen or bathroom countertops, and may be refillable. Traditional liquid dispensing containers are usually transparent, or opaque, and generally do not blend or complement with the surrounding decor of kitchens, or bathrooms where most liquid containers are stored and used.

An exemplary form of a liquid dispensing container comprises a soap-dispensing container. Soap dispensing containers often comprise a molded, plastic bottle sized to hold a predetermined amount of hand soap. Such plastic bottles often include a hand-actuated pump that is fitted with a hollow, elongated tube that extends within the plastic bottle and into the liquid soap. The pump typically includes a threaded collar that threads onto a threaded neck provided on the plastic bottle. The pump is depressed to extract an amount of hand soap from the bottle, up through the hollow, elongate tube, and out from a spout onto users' hands. The pump tube typically does not reach the bottom of the bottle, and thus a relatively small amount of liquid at the bottom of the container, beneath the pump tube, is unable to be dispensed by the pump. In consequence, many people will discard the bottle when only said small amount of liquid remains in the bottle, as it is impossible or inconvenient to dispense this remaining liquid. This causes a waste of unused product, and therefore economic loss and premature contribution to environmental impact of plastic bottles to the landfills or other disposal systems Many individuals prefer using hand-operated soap dispensers in comparison to using solid bars of soap since the latter often leaves soap residue on soap dishes, or on countertops between uses. Another type of liquid dispensing container includes a plastic bottle or container for holding shampoo. Shampoo bottles generally include a bottle having a threaded neck, and a threaded cap including an aperture and flip-open lid that covers the aperture. The threaded cap is removably attached to the threaded neck of the bottle. In use, users rotate the flip-open lid, and invert the shampoo bottle by hand to dispense shampoo from the shampoo bottle by gravity allowing shampoo to pass through the aperture and onto the user's hand for washing hair.

Traditional containers and bottles employed for storing and holding hand soap, body wash, or shampoo provide various drawbacks. For instance, in practice it is difficult to dispense soap and/or shampoo from bottles when nearing the end supply of the liquid contents. Due to the thick and viscous nature of the liquid content, users often find themselves vigorously shaking or jerking the bottle in an effort to expel the last remaining quantity of liquid from the bottle. However, after applying the concerted effort, there remains a small quantity of liquid content within the shampoo bottle, even after repeated attempts are made by users to fully dispense the liquid from the bottle. Some individuals often resort to placing and resting bottles in an inverted position on a rack or counter to allow the liquid to gradually drizzle down by gravity. This practice however, poses a challenge when attempting to dispense the liquid from the bottle as the liquid often gushes out of the bottle upon opening the flip-open lid as a result of liquid having migrated down towards the cap often creating a mess, or outpouring a larger quantity of liquid needed for use. In addition, the loosely positioned, inverted bottles are unappealing, provide clutter, and often shift out of position and fall out of place defeating the original purpose.

Accordingly, there is an established need for a liquid dispensing assembly for effectively housing and concealing a container that is securely retained within the assembly in an inverted position to facilitate complete dispensing of liquid from the inverted container in a controlled manner, is easy to operate, and accommodates use with containers of various sizes and shapes holding varieties of different liquids.

SUMMARY OF THE INVENTION

The present invention is directed to a liquid dispensing assembly for housing and concealing an inverted container to facilitate substantial or complete dispensing of liquid from the inverted container. The liquid dispensing assembly provides a convenient mechanism for securely holding and facilitating dispensing liquid substance such as soap, hand sanitizer, shampoo, body wash, body oil, hair conditioner, or other liquid, from corresponding container.

In a first implementation of the invention, a liquid dispensing assembly for housing an inverted container to facilitate substantially complete dispensing of a liquid from the inverted container comprises a housing. The housing defines an interior space configured to receive an inverted container containing a liquid substance. A socket is provided within the interior space of the housing, for receiving a neck of the inverted container. The liquid dispensing assembly further includes a pump assembly carried by the housing. The pump assembly is in fluid communication with the socket of the housing and is operable from outside the housing to dispense fluid from the inverted container, through the neck of the inverted container and via a delivery aperture of the pump assembly located outside the housing.

In a second aspect, the pump assembly may be arranged below the level of the liquid product stored inside the inverted container.

In another aspect, the housing may be configured to enclose the inverted container within the interior space of the housing.

In another aspect, the housing may include a first housing portion and a second housing portion disconnectably mountable to one another to enclose the interior space.

In another aspect, the first housing portion and second housing portion may each include or define a respective interior space. The interior space of the housing may be formed by the interior space of the first housing portion and the interior space of the second housing portion. The interior space of the second housing portion may be configured to receive at least part of the inverted container when the neck of the inverted container is mounted to the socket.

In another aspect, the socket may be provided in the first housing portion.

In yet another aspect, the pump assembly may be carried by the first housing portion.

In another aspect, the first housing portion may include a pair of cutouts arranged at opposite sides of a top end of the first housing portion. The cutouts may be configured to facilitate inserting a subject's fingers therethrough to manually grasp an inverted container housed within the first housing portion.

In another aspect, the housing may be at least partially see-through to enable viewing the inverted container.

In another aspect, the second housing portion may include at least one spike configured to perforate the inverted container, to form at least one corresponding vent opening through the inverted container.

In yet another aspect, the second housing portion may be formed as a top cover mountable on the first housing portion. The at least one spike of the second housing portion may be configured to perforate at least one perforable area provided on a top end of the inverted container opposite to the neck of the inverted container.

In another aspect, the socket may extend downward from an internal wall of the housing and in fluid communication with an opening formed through said internal wall.

In another aspect, the internal wall may provide a partition that divides the interior space of the housing into a first subspace and a second subspace. The first subspace may be configured to receive the inverted container. Fluid communication between the pump assembly and the socket may be provided through the second subspace.

In another aspect, the liquid dispensing assembly may further include a delivery conduit arranged within the second subspace. The delivery conduit may extend from and be in fluid communication with the socket. The pump assembly may extend from and be in fluid communication with the delivery conduit.

In yet another aspect, a first end of the delivery conduit may be connected to a nipple of the socket and an opposite second end of the delivery conduit may be connected to the pump assembly.

In another aspect, the liquid dispensing assembly may further include a spike arranged at the socket, the spike configured to perforate a perforable membrane carried by the neck of the inverted container and establish fluid communication between the inverted container and the socket.

In another aspect, the spike may include at least one through opening providing fluid communication between the neck of the inverted container and the pump assembly.

In another aspect, the pump assembly may include a plunger, a flange, and a delivery spout. The flange and delivery spout may be located outside the housing, the delivery spout comprising the delivery aperture. The delivery spout may be operable to reciprocate the plunger to dispense a quantity of said liquid substance from the inverted container.

In yet another aspect, the liquid dispensing assembly may further include a wall mount, comprising at least one attachment for securing the wall mount to a vertical surface, and a base for supporting the housing with the pump assembly extending outward of the vertical surface.

In another aspect, the socket may be sized and configured to receive and sealingly engage necks having different sizes.

In another aspect, the delivery conduit may include a 90-degree angle or elbow, or an elongate meandering delivery conduit.

In one aspect, the second housing portion and the first housing portion of the dispensing container may comprise a variety of geometric shapes including a cylindrical, a square, a rectangular, or an oval shape.

In another aspect, the interior space of the housing may be sized and configured to accommodate inverted containers having various shapes and sizes.

In one aspect, the socket may include at least one socket seal such as, but not limited to, at least one seal rib, one or more gaskets, or one or more seal rings.

In another aspect, the inverted container may include a commercially available, disposable or single-use container.

In yet another aspect, the housing may be fabricated from a molded plastic, wood, metal material, or any combination thereof.

In another aspect, the housing may include various styles, patterns, designs, patterns, or colors to enhance aesthetic appeal.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a liquid dispensing assembly configured for housing and concealing inverted containers having different sizes and shapes, and including a liquid, and including a pump assembly for dispensing liquid from the inverted containers to facilitate substantially complete dispensing of the liquid from the inverted container in a controlled manner.

It is understood that the term, "inverted container" as used herein refers to containers including any receptacle designed for holding liquid that may include any shape and size, and that may be constructed from aluminum, glass, or plastic, for instance and without limitation. The term, "liquid" as used herein refers to exemplary forms of liquids including any of hand soap, hand sanitizer, shampoo, gel, body wash, dish soap, hair conditioner, or oil.

Figure 1:
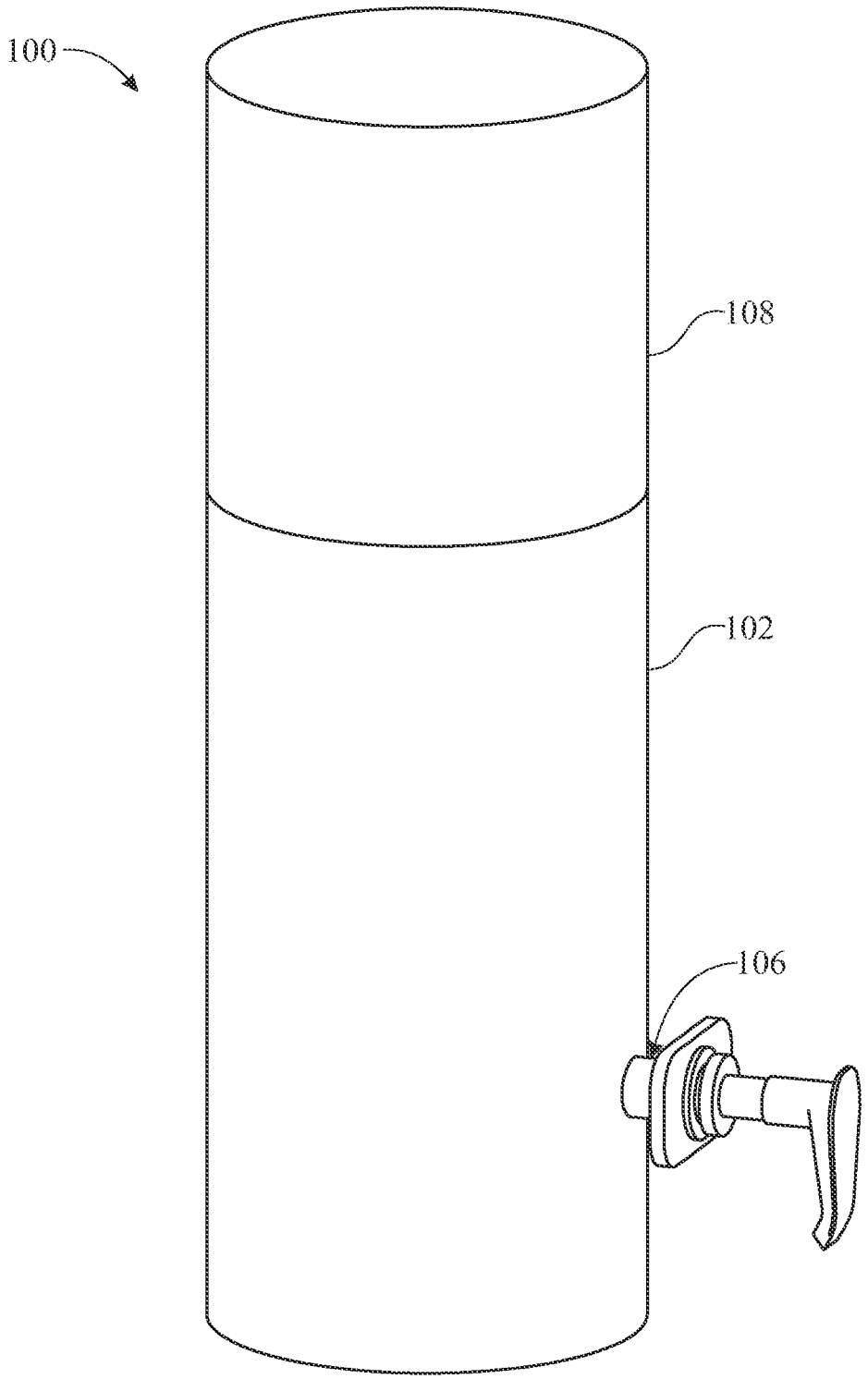
FIG. 1 presents a side, perspective view of a liquid dispensing assembly, showing a first housing portion, a second housing portion attached to the first housing portion, and a pump assembly, in accordance with an embodiment of the present invention.
Figure 2:
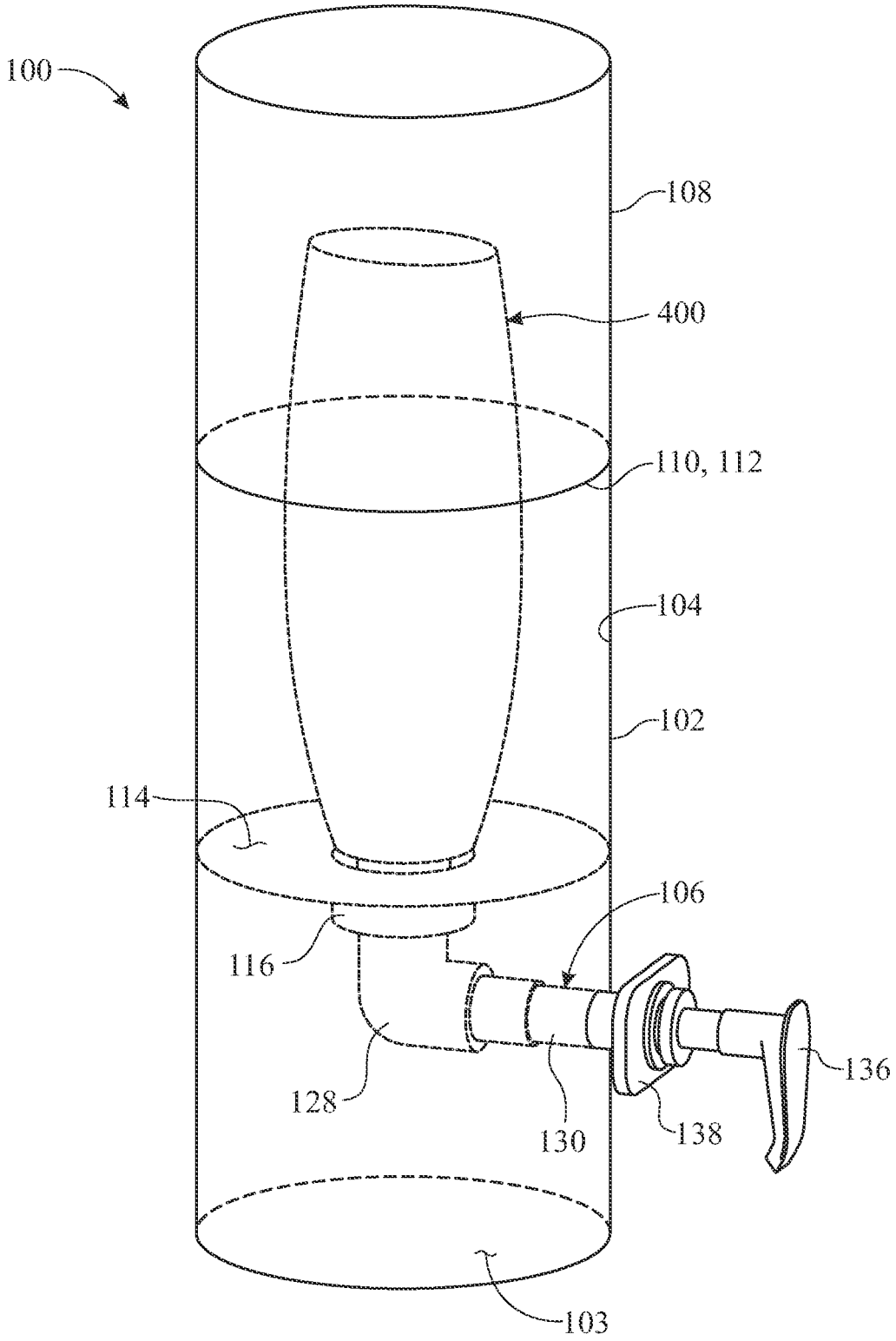
FIG. 2 presents a side, perspective view of the liquid dispensing assembly of FIG. 1, showing a base interior of the first housing portion including an inverted container, holding a liquid, housed within the base interior, with a neck of the inverted container disposed within a container socket communicating with the pump assembly for dispensing liquid from the inverted container.

Referring now to FIGS. 1 and 2, there are shown two perspective views of a housing assembly 100 of a liquid dispensing container and housing assembly, in accordance with an exemplary embodiment of the present invention, wherein the second perspective view is similar to the first perspective view and additionally shows several hidden elements of the housing assembly 100. The housing assembly 100 includes or defines an interior space 101 for removably housing a liquid substance container 400, in an inverted position, to facilitate dispensing the liquid contained in the container 400 as will be described in detail hereinafter. The housing assembly 100 may be made of several parts; for example, the housing assembly 100 of the present embodiment includes a housing base or first housing portion 102 and a housing lid or second housing portion 108 removably attachable to the first housing portion 102. The first housing portion 102 may be generally hollow, and include an inner wall 104 defining an interior space 105 of the first housing portion 102. In turn, in some embodiments, the second housing portion 108 may be non-planar, as shown, i.e. may include one or more walls defining an interior space 109. When the second housing portion 108 is attached to the first housing portion 102, the second housing portion 108 and first housing portion 102 jointly enclose an interior space 101 of the housing assembly 100, in which the inverted container 400 is housed. The housing assembly 100 may be transparent, translucent, opaque, or combinations thereof. In some embodiments, the housing assembly 100 may be configured to conceal the container 400 from the outside observer, such as by having all external surfaces of the first housing portion 102 and second housing portion 108 opaque.

The housing assembly 100 further comprises a pump assembly 106, which is preferably at least partially housed within the first housing portion 102, below the level of the liquid product stored inside the inverted container 400. The liquid within the container 400 may be selectively gravity-fed and dispensed from inverted container 400 via pump assembly 106. By having the container 400 arranged in an inverted position, it is ensured that substantially all the liquid in the container 400 is fully or substantially dispensed, while optionally concealing the appearance of the inverted container 400 within first housing portion 102.

In some embodiments, the housing assembly 100 may be placed on a flat surface for use and/or storage. In one exemplary embodiment, a friction material may be provided on the underside surface 103 of first housing portion 102, such as to prevent the first housing portion 102 from sliding or moving along the surface during use. Such friction material may include rubber feet, a rubber padding, a gel or silicone pad, suction cups, a magnetic attachment configuration, or engineered mechanical support.

Figure 3:
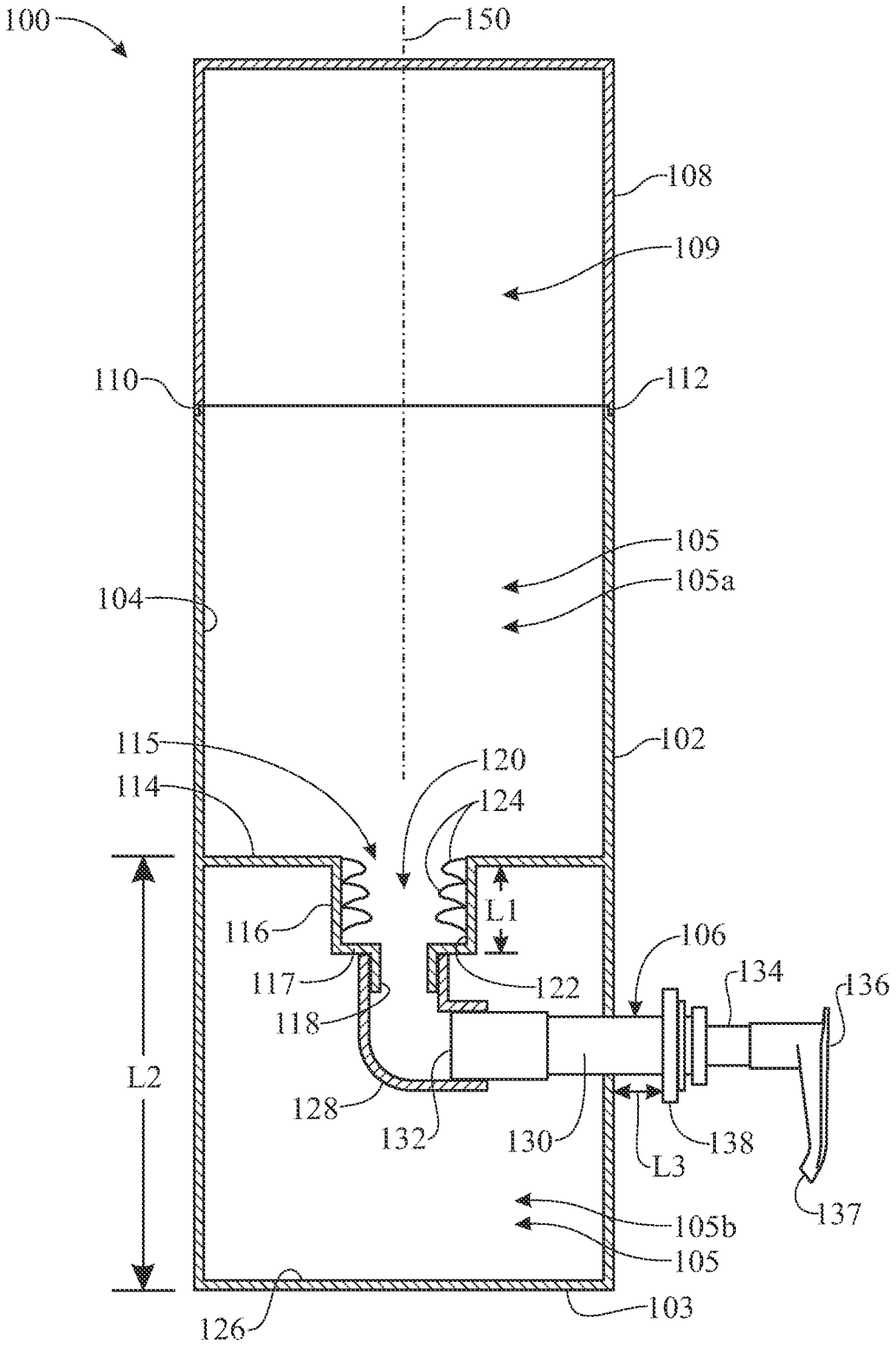
FIG. 3 presents a cross-sectional view of the liquid dispensing assembly of FIG. 1, showing the container socket attached to a delivery conduit for connecting the container socket to the pump assembly.

With reference made to FIGS. 2, and 3, the second housing portion 108 may be removably attached to the first housing portion 102 by attachments such as, but not limited to, flanges 110, 112, a threaded connection, a snap-lock configuration, a magnetic attachment, or frictional engagement. In one exemplary embodiment, housing assembly 100 is shown as having a round, geometric shape, but may include any shape including a square, a rectangular, or an oval shape. The dimensional size of the first housing portion 102 and second housing portion 108 may be proportional to the size of an inverted container 400 employed. In contemplation of a housing assembly 100 comprising a round geometric shape, there may be included flanges 110, 112 comprising circular flanges provided on both the first housing portion 102 and second housing portion 108. In some embodiments, such as the present embodiment, the shape of the first housing portion 102 and second housing portion 108 may be independent or unrelated to the shape of the container 400. It is appreciated that the second housing portion 108 is shown as one single unit, but may, in one exemplary embodiment comprise multiple pieces that attach together to form one second housing portion 108.

With continued reference to FIGS. 2 and 3, the housing assembly 100 may further include an internal wall 114 which, as shown, may be formed as a partition within the first housing portion 102 that divides the interior space 105 of the first housing portion 102 into an upper or first subspace 105*a*, which receives a container 300, 400, and a lower or second subspace 105*b*, which receives part of the pump assembly 106, and associated fluid tubing, described hereinafter. In some embodiments, the internal wall 114 may be a relatively thin, planar wall extending from the interior walls of the first housing portion 102, across the interior space 105, along a plane which is radial or transverse relative to a longitudinal axis 160 of the first housing portion 102 and second housing portion 108, as shown. The internal wall 114 may include a through opening 115. A downwardly extending receptacle, seat or tube 116 having a length L1 may extend downward from the opening 115, forming a container socket 120 having an inner wall 122 which defines and surrounds the container socket 120. In some embodiments, the tube 116 may have a circular transverse cross-section. A nipple 118 may extend longitudinally downward from an end wall or base 117 of the downwardly extending tube 116 to provide the tube 116 with a narrower ending or neck. In one non-limiting embodiment, the tube 116 may be circular and comprise any diameter, and include a length L1 of ¾ inches. In a non-limiting embodiment, the internal wall 114 is attached to the inner wall 104 of the first housing portion 102 a predetermined length or height from the first housing portion floor 126, as denoted by L2 in FIG. 3. One exemplary measure includes a length L2 of 2½ inches. It is noted that the diametrical size of the nipple 118 of the present embodiment is smaller than the diametrical size of tube 116. In turn, the container socket 120 may have various dimensions. In some embodiments, container socket 120 may have a width or diameter of ½ to 2 inches with a preferred size of 1⅛ inches, and a depth of ½ to 1 inch with a preferred size of ¾ of an inch, although in other embodiments these dimensions may vary.

Figure 4:
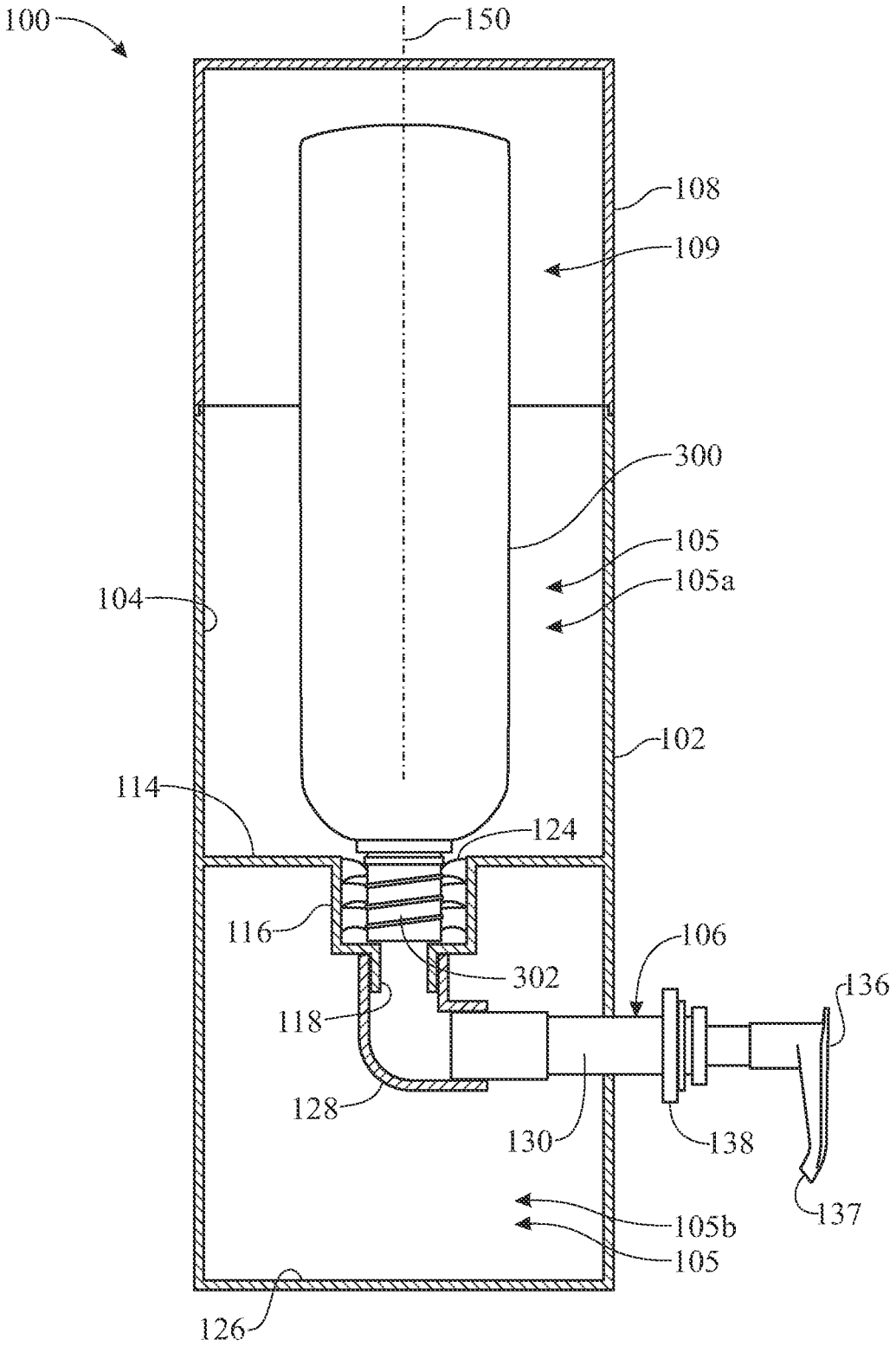
FIG. 4 presents a cross-sectional view of the liquid dispensing assembly of FIG. 3, showing an inverted container, comprising one shape, housed within the base interior, and including a neck disposed within the container socket for readily dispensing liquid from the inverted container, via the pump assembly.

A socket seal 124 is provided within the container socket 120 to accommodate removable attachment of necks 302, 402 of inverted containers 300, 400, as illustrated in FIGS. 3 and 4. Socket seal 124 protrudes inwardly from the interior surface of the container socket 120, such as from the inner wall 122 of the downwardly extending tube 116, and may include a plurality of seal ribs or ridges, which protrude into container socket 120 in spaced-apart rows along the inner wall 122. The seal ribs or ridges of the socket seal 124 ensures a fluid-tight seal between the neck 402 of a container 400, and the container socket 120 while accommodating containers 400 of various sizes. In another embodiment, one or more silicone or rubber gaskets, or ribs are affixed to the inner wall 122 of container socket 120. The socket seal 124 may be removable, or in one alternative embodiment, permanently affixed within container socket 120. The socket seal 124 is sized to accommodate necks 302, 402 of different sizes thus allowing the housing assembly 100 to be used with a large variety of containers holding different liquids.

With continued reference made to FIGS. 2 and 3, housing assembly 100 includes a delivery conduit 128 having one end attached to and extending from the nipple 118, and another end attached to and extending from the pump assembly 106. Delivery conduit 128 may attach to nipple 118 via, threads, detents, or be permanently affixed using industrial, or medical grade glue or adhesive. The delivery conduit 128 may comprise a plastic, silicone, or rubber material whose inner diameter is slightly larger than the outer diameter of nipple 118 to allow, for instance, for a friction fit between the delivery conduit 128 and the nipple 118; alternatively or additionally, the delivery conduit 128 may be attached to the nipple 118 by an adhesive, threading, or other applicable means. In one exemplary embodiment, delivery conduit 128 comprises a right angle, 90 degree, or elbow conduit. As shown in FIG. 3, the delivery conduit 128 of the present embodiment is a separate and distinct piece from nipple 118; however, to reduce costs, and the need for added parts, the nipple 118 may instead extend downwards and include a curved or 90-degree angle thereby providing one integral piece (integrally including the delivery conduit 128) and replacing the need for employing a separate delivery conduit 128.

Pump assembly 106 extends partially within, and outwards from, first housing portion 102. Pump assembly 106 includes a reciprocating plunger 130 having one end 132 attached to one end of delivery conduit 128, and an opposite end 134 attached to a delivery spout 136 including a delivery aperture 137 for dispensing an amount of liquid from an inverted container 400, as shown in FIG. 2. The plunger 130 is in fluid communication with container socket 120 through delivery conduit 128. A pump flange 138 is provided to permit a user to engage the pump flange 138 with fingers while pushing on the delivery spout 136 with a thumb to reciprocate the plunger 130 to dispense liquid from the inverted container 400. As shown in FIG. 3, a small space, generally denoted at L3 is provided to receive one or more fingers, and position a portion of the plunger 130 between two fingers on one hand, while depressing delivery spout 136 with the thumb. In a preferred embodiment, the pump assembly 106 is leak-proof to prevent liquid from leaking into first housing portion 102.

Figure 7:
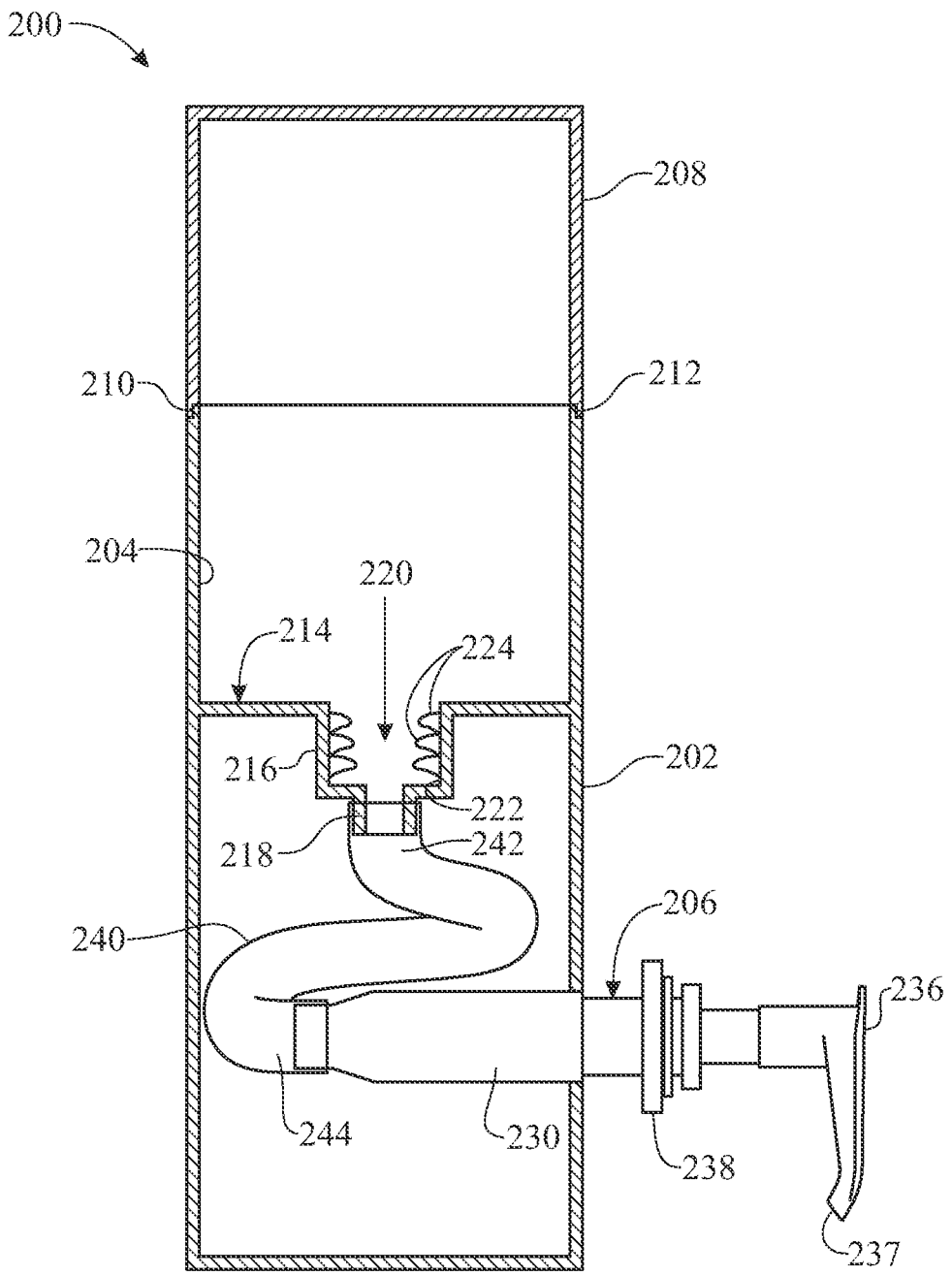
FIG. 7 presents a cross-sectional view of a liquid dispensing assembly, showing a meandering delivery conduit connecting the container socket on the dispensing container to the pump assembly, in accordance with another embodiment of the present invention.

Turning to FIG. 7, there is presented a cross-sectional view of a housing assembly 200 for accommodating containers that are smaller, in accordance with another embodiment of the present invention. Housing assembly 200 is similar in construction to housing assembly 100, with main differences being size to accommodate smaller containers including a liquid, and the inclusion of a meandering delivery conduit 240. Housing assembly 200 includes a housing base or first housing portion 202 having an inner wall 204, and a housing lid or second housing portion 208 removably attached to first housing portion 202 via attachment flanges 210, 212. Housing assembly 200 includes an internal wall 214, similar in construction to the internal wall 114, and includes a downwardly extending tube 216 defining a container socket 220 having a surrounding, inner wall 222. The downwardly extending tube 216 may end in a nipple 218. The downwardly extending tube 216, inner wall 222 and/or nipple 218 may be circular.

A socket seal 224 is provided within the container socket 220 to accommodate removable attachment of necks 302, 402 of inverted bottles or containers 300, 400 when disposed within the socket 220. The socket seal 224 protrudes inwardly from the interior surface or inner wall 222 of the container socket 220, and may include a plurality of seal ribs or ridges, which protrude into container socket 220 in spaced-apart rows along the inner wall surface of the container socket 220. The seal ribs or ridges of the socket seal 224 ensure a fluid-tight sealing connection between the neck 302, 402 of a liquid container 300, 400, and container socket 220 while accommodating containers 300, 400 of various sizes.

With continued reference to FIG. 7, housing assembly 200 includes a meandering delivery conduit 240 having one end 242 attached to nipple 218, and an opposite end 244 attached to a plunger 230 of a pump assembly 206, for connecting the container socket 220 to the pump assembly 206. The meandering delivery conduit 240 allows lateral adjustment of the pump assembly 206 to accommodate use with a first housing portion 202 having different sizes and shapes, thus allowing for reducing the size of both the first housing portion 202 and the second housing portion 208. The meandering delivery conduit 240 may comprise a rubber, silicone, or plastic material, and include any length desired. As such, the footprint of the first housing portion 202, and second housing portion 208 is the same or similar in size to container 300, 400.

As with housing assembly 100, the pump assembly 206 of housing assembly 200 extends partially within and outwards from the first housing portion 202. Pump assembly 206 includes a reciprocating plunger 230 having one end attached to the end 244 of the meandering delivery conduit 240 opposite to the nipple 218, and an opposite end attached to a delivery spout 236 including a delivery aperture 237 for dispensing an amount of liquid from an inverted container 400, as shown in FIG. 2. The plunger 230 is in fluid communication with the container socket 220 through the delivery conduit 240. A pump flange 238 is provided to hold with fingers while pushing on the delivery spout 236 towards the pump flange 238 with a thumb, to reciprocate plunger 230 and dispense liquid from inverted container 400.

Figure 5:
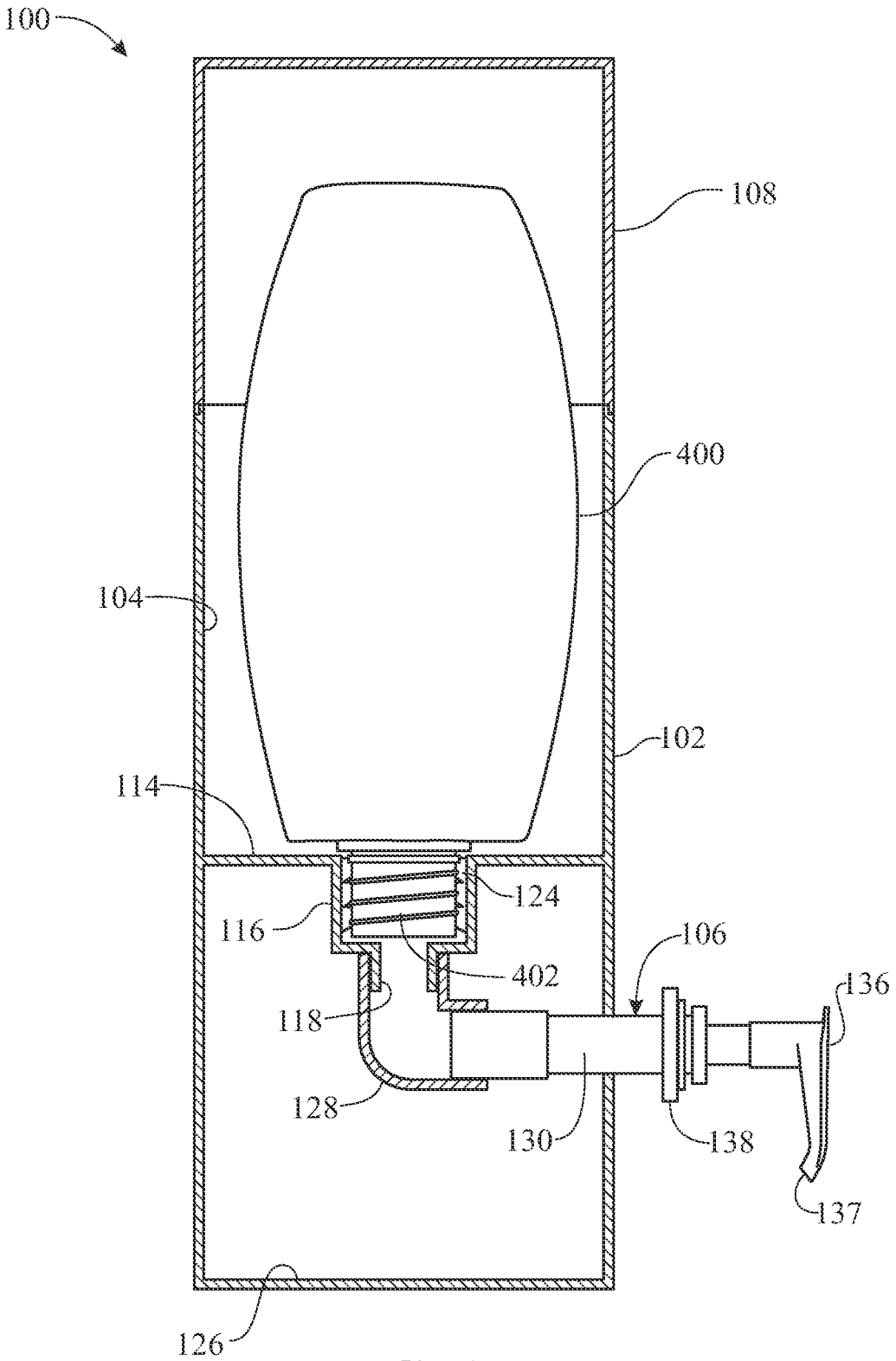
FIG. 5 presents a cross-sectional view of the liquid dispensing assembly of FIG. 3, showing an inverted container, comprising another shape, housed within the base interior, and including a neck disposed within the container socket for readily dispensing liquid from the inverted container, via the pump assembly.

Turning now to FIGS. 4 and 5 there are shown cross-sectional views of the housing assembly 100 of FIG. 3, and an operative view, respectively, of mounting a container 300, 400 within the housing assembly 100. Two different containers 300, 400 are shown interchangeably housed within the inner wall 104 of the first housing portion 102, in an inverted position, with the second housing portion 108 affixed to the first housing portion 102 to enclose and conceal the inverted container 300 or 400. The respective neck 302, 402 of each container 300, 400 is each disposed within the container socket 120 for readily dispensing liquid from the inverted container 300, 400, via pump assembly 106. Containers 300, 400 may comprise commercially available containers, each containing, for instance and without limitation, a different liquid content commonly utilized by consumers. Each neck 302, 402 securely engages the socket seal 124 provided within the container socket 120 to provide a tightly sealed attachment. It is understood that ridges of socket seal 124 engage valleys of threads provided on the external surface of each neck 302, 402, of each respective inverted container 300, 400 to assure a tight, secure, and preferably fluid-tight or sealed connection. While not expressly shown, the containers 300, 400 would be similarly installable inside the housing assembly 200 of FIG. 7.

Figure 6:
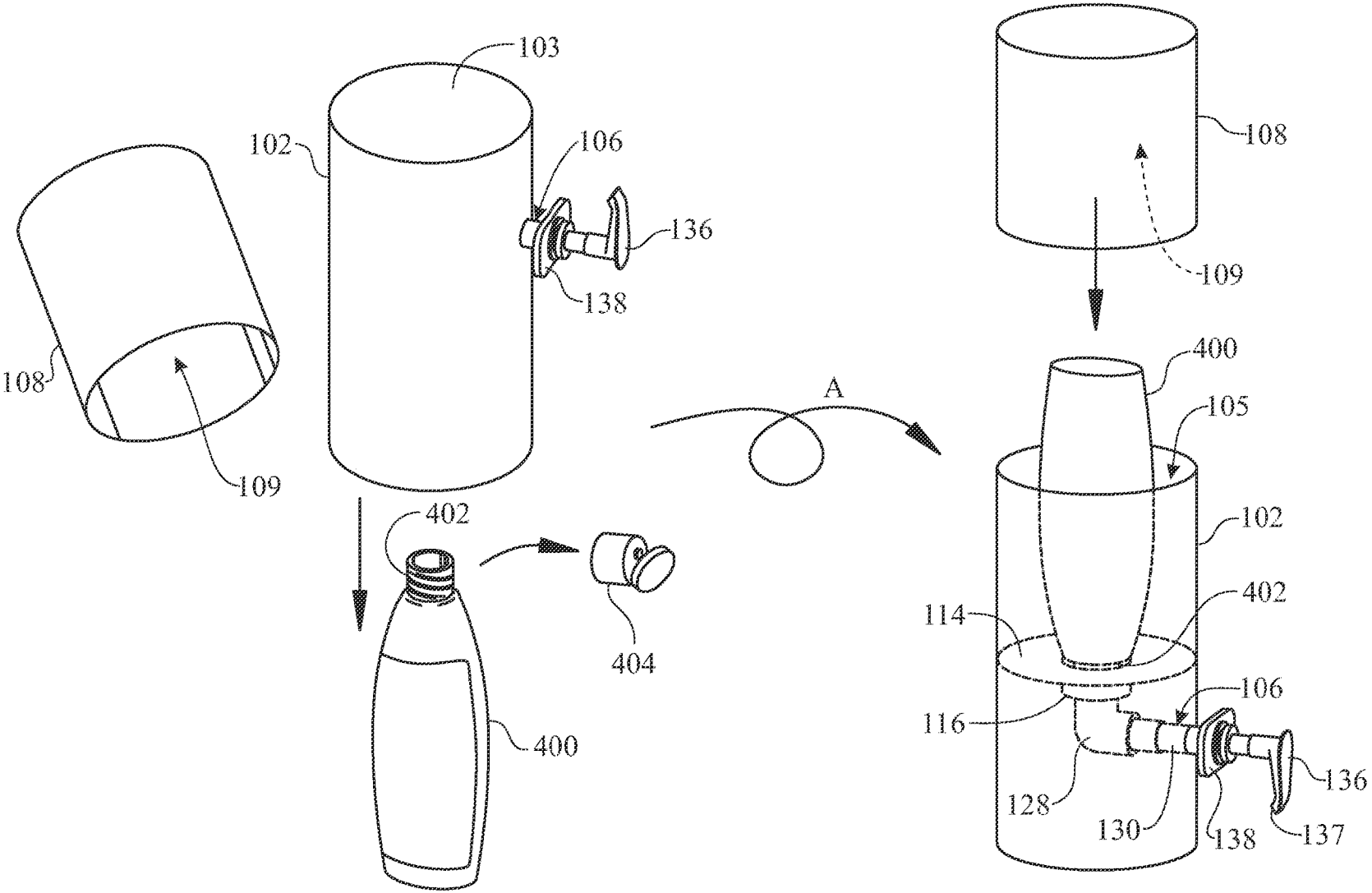
FIG. 6 presents exploded, perspective views, showing installment of a container in the dispensing container housing assembly, and the dispensing container housing assembly and container both inverted into an operative position for readily dispensing liquid from the inverted container.

As illustrated in FIG. 6, when preparing to use housing assembly 100 (or 200) with containers for dispensing liquid from the containers in a controlled manner, users first select the type of container they wish to employ for dispensing liquid such as hand soap or shampoo. For example, the user may select container 400. The upper top closure 404 of the container 400 is then removed to expose the upper neck 402 of container 400, with the container 400 in an upright position. The second housing portion 108 is initially removed from first housing portion 102, and the first housing portion 102 is inverted, such that the underside surface 103 of the first housing portion 102 becomes arranged at the top. The inverted first housing portion 102 is then disposed on top of and fitted over the upper portion of container 400, such that the neck 402 becomes securely disposed within the container socket 120 and the neck 402 securely mates and engages with the socket seal 124. The first housing portion 102 and attached container 400 are subsequently vertically inverted, as indicated by arrow A, to adopt a second position, in which the first housing portion 102 is upright and the container 400 is inverted. Next, the second housing portion 108 is attached to first housing portion 102 enclosing, and concealing container 400 therein in the inverted position. The inverted container 400 improves the ability to consume all or most of the contents of the container 400 and favors liquid flow into delivery conduit 128 with the help of gravity. Upon complete assembly of the container 400 within the first housing portion 102, users are free to grasp the flange 138 with fingers of one hand, while utilizing the thumb of the hand to push the delivery spout 136 reciprocating plunger 130 to dispense a quantity of liquid from the inverted container 400 in a controlled, hygiene manner. When operating the pump assembly 106, liquid flows down within container 400 through the delivery conduit 128, and out from the delivery aperture 137 provided in the delivery spout 136. Because the container 400 remains inverted at all times within the first housing portion 102, all the liquid inside the inverted container 400 flows downwards within the delivery conduit 128 by gravity to provide dispensing all or substantially all of the liquid from container 400. Upon depletion of the liquid from container 400, the second housing portion 108 is removed from the first housing portion 102, the container 400 removed from the container socket 120, and a replacement container 400 is replaced in the housing assembly 100, 200 as heretofore described with respect to FIG. 7. In embodiments in which the second housing portion 108 is non planar and, as described heretofore, defines an interior space 109 which is configured to house part of the container 400 when the second housing portion 108 is mounted on the first housing portion 102, removal of the second housing portion 108 allows to expose a bottom end (top end, in the inverted position) of the container 400 and to more easily grasp the container 400 to remove the container 400 from the first housing portion 102.

The illustrations of FIGS. 8-14 show a liquid dispensing container and housing assembly for housing an inverted container to facilitate substantially complete dispensing of a liquid from the inverted container, in accordance with a further embodiment of the invention. Similarly to previous embodiments, the liquid dispensing container and housing assembly comprises a housing assembly 500 including a housing, wherein the housing comprises a first housing portion 502 and a second housing portion 508 mountable to one another to enclose an interior space 501 of the housing configured to receive an inverted container 600 (FIG. 12) containing a liquid substance. In the present embodiment, the second housing portion 508 is formed as a relatively planar lid configured to close a top end of the first housing portion 502, such that a container 600 housed within the housing is substantially entirely or entirely received within an interior space 505 of the first housing portion 502. However, alternative embodiments are contemplated in which, similarly to the previous embodiments, the second housing portion 508 may be non-planar, such as formed as a cap as in the previous embodiments, and such that the interior space 501 of the housing configured to house a container 600 may be provided by an interior space of the second housing portions 508 (similarly to the interior space 109 of the second housing portion 108) in addition to the interior space 505 of the first housing portion 502.

The housing further includes a container socket 520 arranged within the interior space 501 of the housing and, more particularly, provided in the first housing portion 502. As in the previous embodiments, the container socket 520 is configured to receive a neck 602 of the container 600. Also similarly to the previous embodiments, the container socket 520 of the present embodiment forms part of or is carried by the first housing portion 502.

The housing further comprises a pump assembly 506 carried by the housing, and more particularly, by the first housing portion 502. Similarly to the previous embodiment, the pump assembly 506 may include a plunger 530, a flange 538, and a delivery spout 536, with the flange 538 and the delivery spout 536 located outside the housing, and the delivery spout 536 comprising a delivery aperture 537. Similarly to previous embodiments, the pump assembly 506 is in fluid communication with the container socket 520 of the housing and is operable from outside the housing to dispense fluid from the inverted container 600, through the container neck 602 that is received in the container socket 520, and via a delivery aperture 537 of the pump assembly 506 located outside the housing. For example, the delivery spout 536 may be operable to reciprocate the plunger 530 to dispense a quantity of the liquid substance from the inverted container 600 through the delivery aperture 537.

Figure 8:
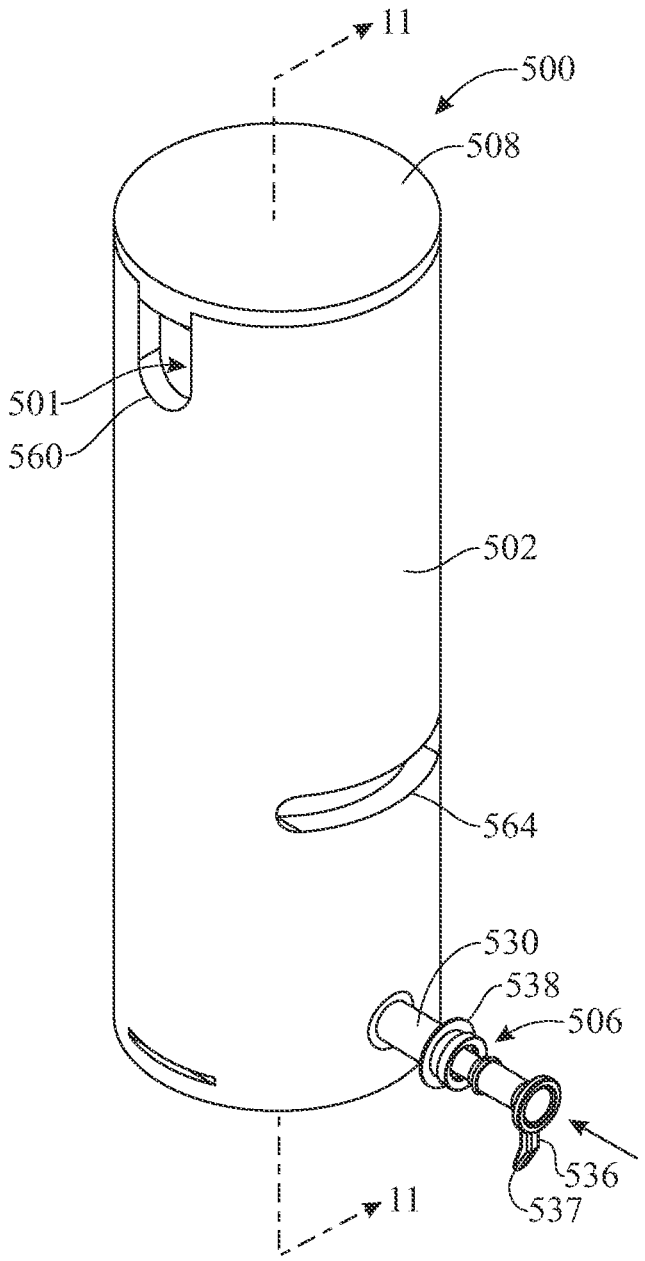
FIG. 8 presents a top side isometric view of a housing assembly of a liquid dispensing container and housing assembly in accordance with a further embodiment of the invention, showing the housing portion mounted to the first housing portion.
Figure 9:
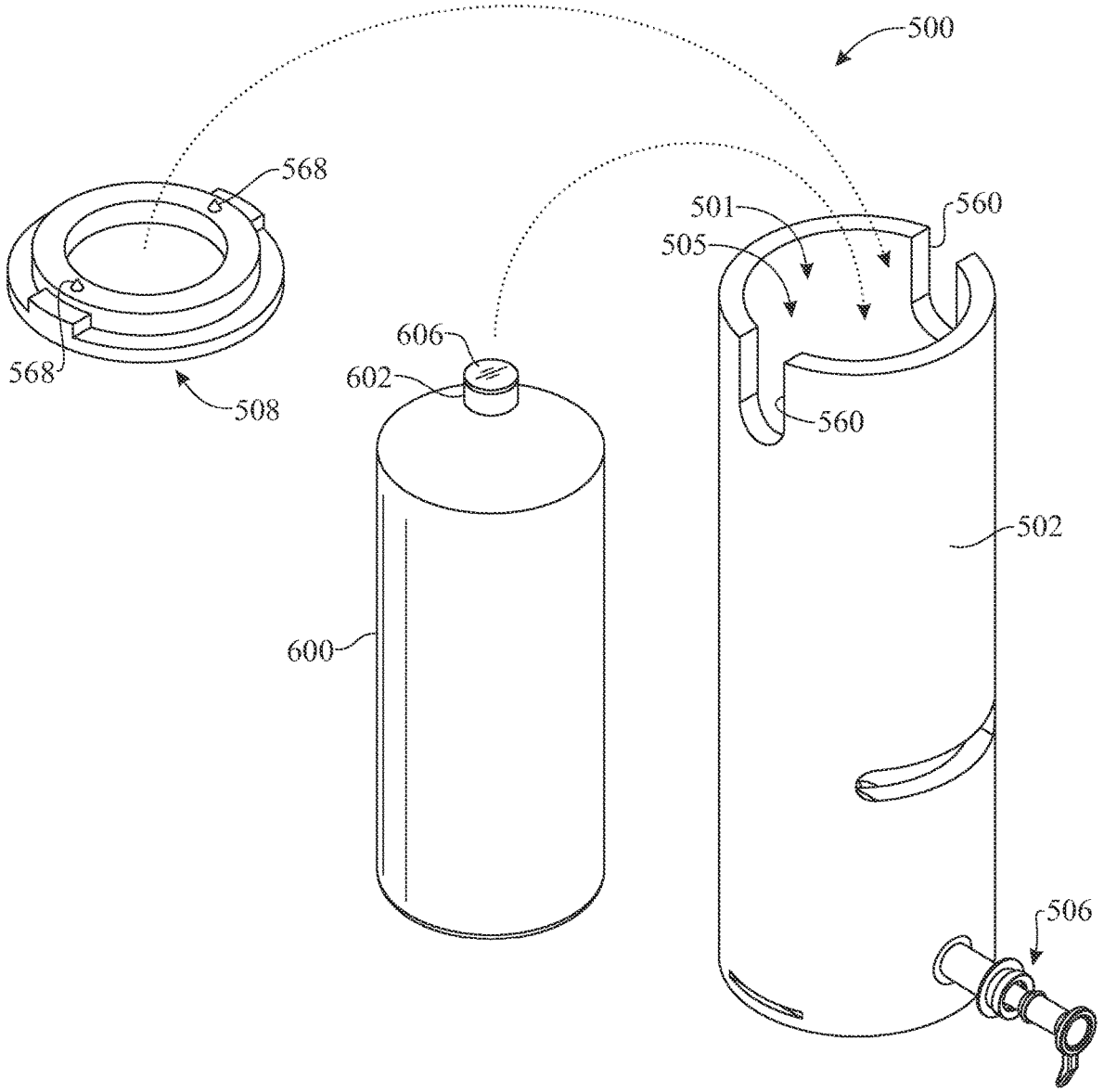
FIG. 9 presents a top side isometric view of the assembly of FIG. 8, with the second housing portion removed from the first housing portion, the view illustrating the mounting of a container inside the first housing portion prior to placing the second housing portion on the first housing portion.
Figure 10:
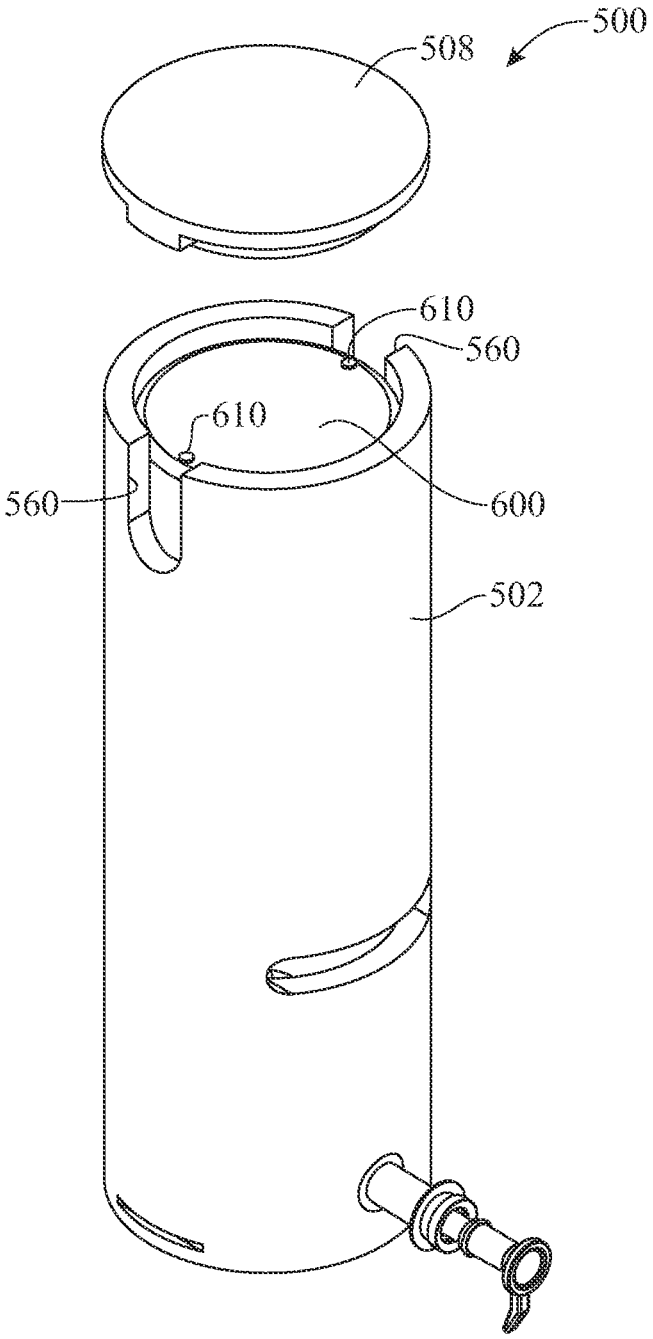
FIG. 10 presents a top side isometric view of the components of FIG. 9, with inverted container housed inside the first housing portion and the second housing portion being mounted on the first housing portion.

As best shown in FIGS. 8 and 10, the first housing portion 502 comprises a pair of cutouts 560 arranged at opposite sides of a top end of the first housing portion 502. The cutouts 560 are configured to facilitate inserting a subject's fingers therethrough to manually grasp the inverted container 600 which is housed within the first housing portion 502 and connected to the container socket 520.

In some embodiments, the housing may be at least partially see-through, to facilitate viewing the inverted container housed inside the housing. For instance, in the present embodiment, the first housing portion 502 comprises a see-through window or opening 564 aligned with the interior space 505 of the first housing portion 502, and with the container 600 container within said interior space 505. The see-through window or opening 564 allows, for instance, to check whether or not a container 600 has been placed within the housing, and to determine the amount of liquid substance left inside the container 600 (if transparent or translucent) so that the housekeeper or other person in charge of supervising the liquid dispensing container and housing assembly knows when to replace or refill the container 600.

Figure 11:
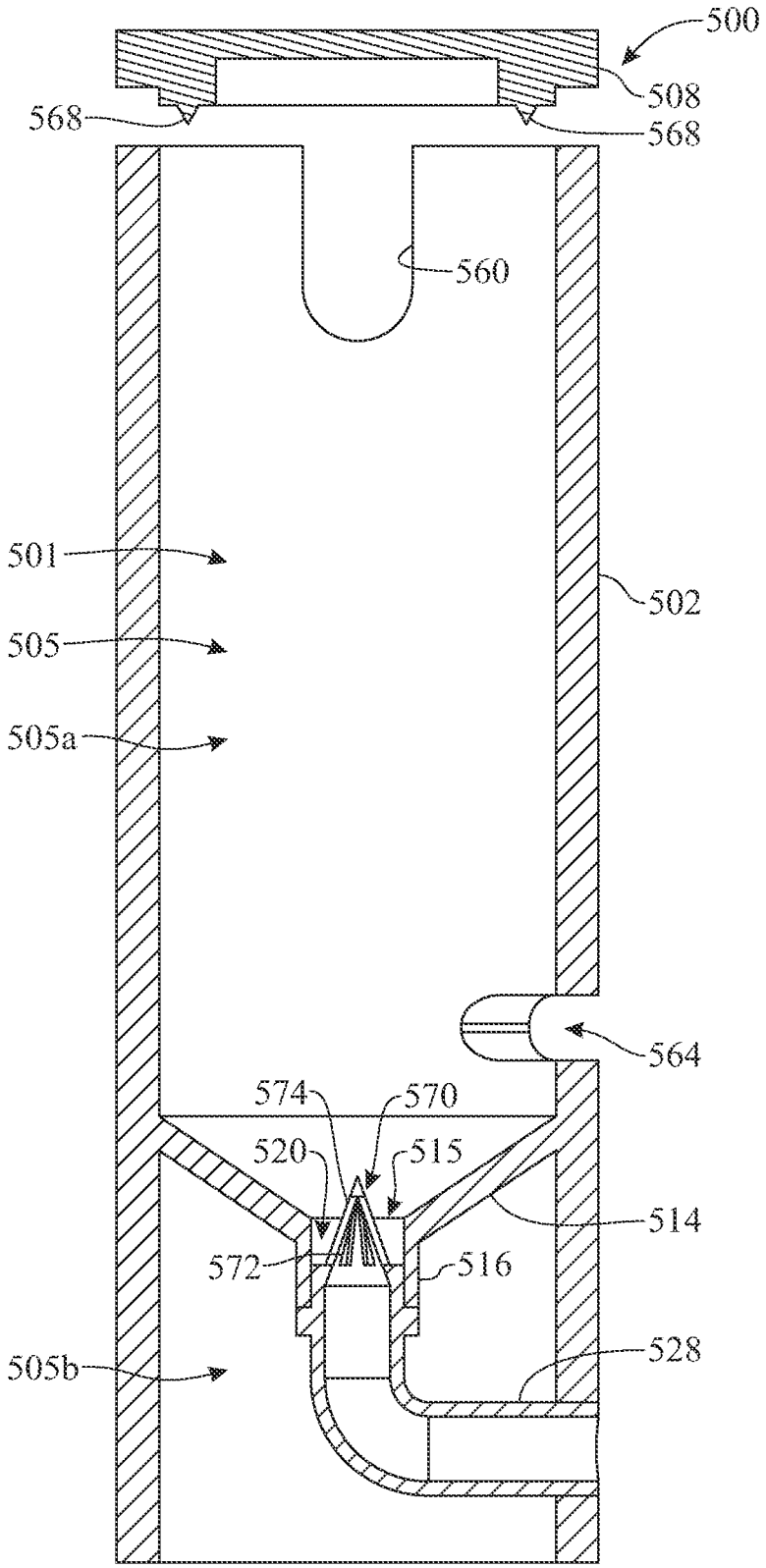
FIG. 11 presents a cross-sectional side elevation view of the first and second housing portions of FIG. 8, the cross-section taken along section plane 11-11, with the second housing portion shown separated from the first housing portion.
Figure 12:
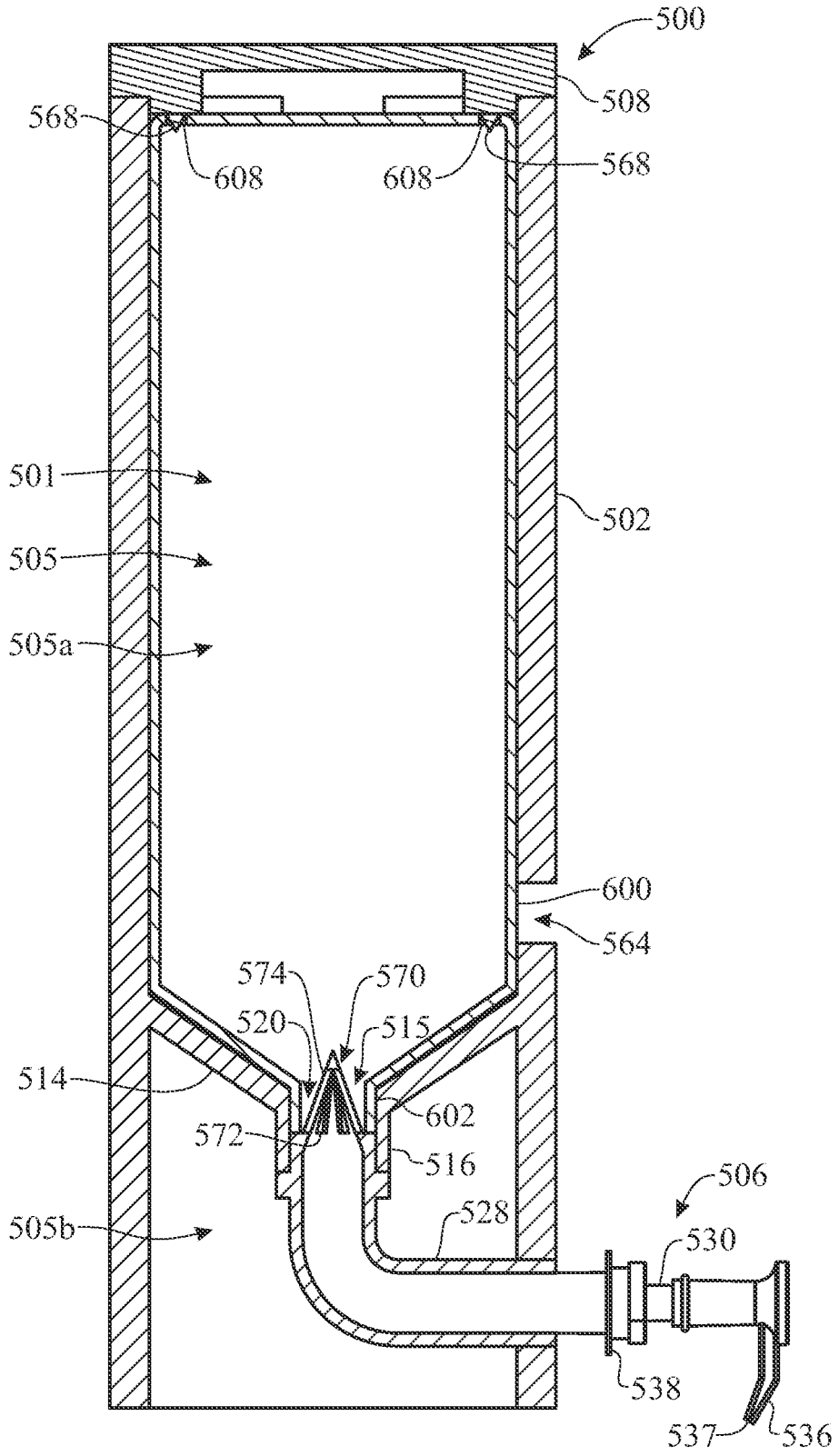
FIG. 12 presents a cross-sectional side elevation view similar to FIG. 11, further showing the container housed inside the first housing portion in an inverted position, with the container neck received in the container socket, and the second housing portion fitted onto the first housing portion.

With reference to the cross-sectional views of FIGS. 11 and 12, as shown, the second housing portion 508 may include at least one perforating member or spike 568 (e.g., a pair of spikes 568, as shown) protruding outwardly and configured to perforate the inverted container 600, to form at least one corresponding vent opening 608 through the inverted container 600. For instance, the second housing portion 508 may be formed as a top cover mountable on the first housing portion 502 and the at least one spike 568 of the second housing portion 508 may protrude downward from the second housing portion 508 towards the interior space 501 of the first housing portion 502 when the second housing portion 508 is mounted on the first housing portion 502. In some embodiments, the one or more spikes 568 may be configured to perforate at least one perforable area 610 (FIG. 10) provided on a top end 604 of the inverted container 600 opposite to the neck 602 of the inverted container 600. The perforable area 610 may include, for instance and without limitation, a perforable membrane, film, wall, or other perforable, pierceable or breakable material or structure.

Similarly to the previous embodiments, the container socket 520 of the present embodiment comprises a tube 516 configured to receive the neck 602 of the inverted container 600. The tube 516 extends downward from an internal wall 514 of the housing (and more particularly, of the first housing portion 502) and is in fluid communication with an opening 515 formed through said internal wall 514. The internal wall 514 provides a partition that divides the interior space 501 of the housing, and more specifically, that divides the interior space 505 of the first housing portion 502, into a first subspace **505*a* and a second subspace 505*b*. As best shown in FIG. 12, the first subspace 505*a* is configured to receive the inverted container 600. In turn, the second subspace 505*b* provides a space through which fluid communication between the pump assembly 506 and the container socket 520 is granted. For example, similarly to previous embodiments, said fluid communication between the pump assembly 506 and the container socket 520 may take place through a delivery conduit 528 arranged within the second subspace 505*b*. The delivery conduit 528 extends from and is in fluid communication with the container socket 520. In turn, the pump assembly 506 extends from and is in fluid communication with the delivery conduit 528**.

With continued reference to FIGS. 11 and 12, the liquid dispensing assembly of the present embodiment further includes a perforating member or spike 570 arranged at the container socket 520. The spike 570 is configured to perforate a perforable membrane 606, such as a perforable sealing film, provided at the neck 602 of the inverted container 600, when the inverted container 600 is fitted in the housing and the neck 602 is inserted into the socket 520. The perforable membrane 606 may initially seal the interior of the container 600; when the spike 570 perforates the perforable membrane 606, fluid communication is then established between the interior of the inverted container 600 and the container socket 520. As further shown, the spike 570 may include at least one through opening 572 providing fluid communication between the container neck 602 and the pump assembly 506. In some embodiments, such as the present embodiment, the spike 570 may be formed as a hollow, conical body defined by a conical sidewall 574, with the one or more through openings 572 formed through the conical sidewall 574.

Figure 13:
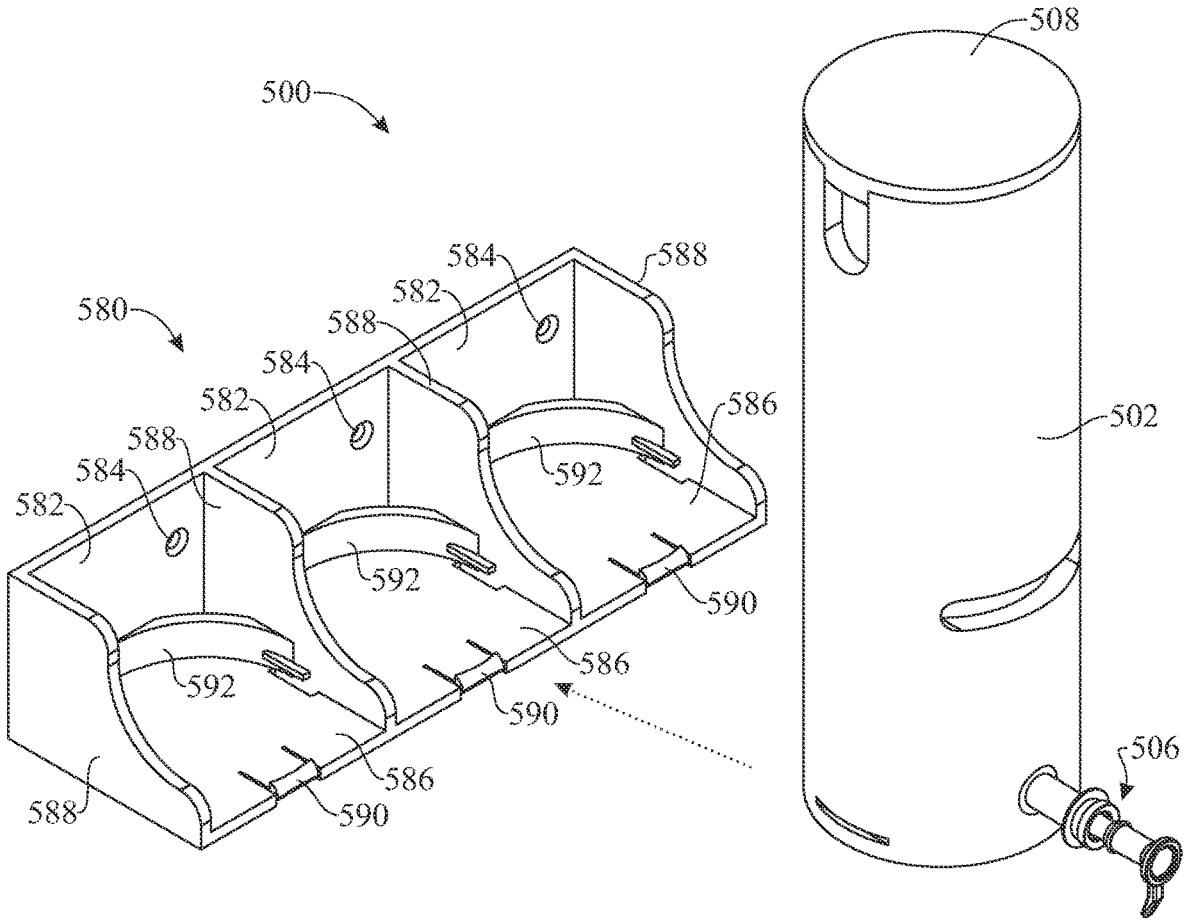
FIG. 13 presents a top, side isometric view of a housing of FIG. 8 being mounted onto a wall mount in accordance with an embodiment of the invention.
Figure 14:
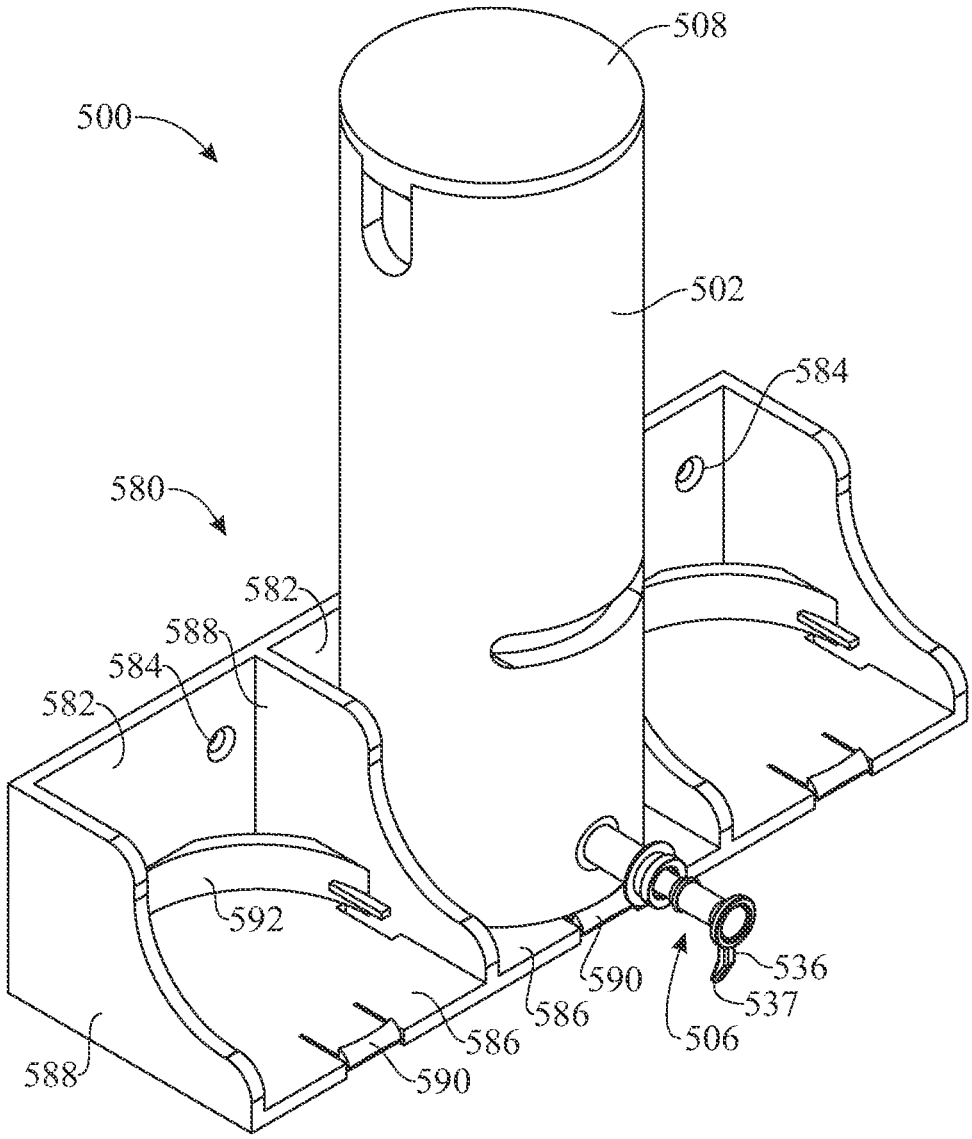
FIG. 14 presents a top, side isometric view of the housing and wall mount of FIG. 8, with the housing mounted on the wall mount.

As shown in FIGS. 13 and 14, in some embodiments, the liquid dispensing assembly may further include a wall mount 580, configured to carry one or more housings, each housing configured to carry an inverted container. The wall mount 580 may include a rear wall 582 including at least one attachment 584 (e.g., a fastener opening) for securing the wall mount 580 to a vertical surface (e.g., a wall), and may further include a respective base 586 for supporting each housing. A pair of sidewalls 588 may extend from the rear wall 582 and each base 586 to limit or block a lateral or sideways movement of the housing, with the sidewalls 588 and bases 586 forming one or more cubicles for receiving a respective one or more housings. For instance, the depicted embodiment shows a wall mount including three cubicles configured to house three separate housings, such as for holding three containers containing, for instance and without limitation, shampoo, hair conditioner, and body wash, respectively. In some embodiments, the base 586 may be formed to match a shape and size of the housing and provide a snug receptacle for the housing. For instance, in the present embodiment, the base 586 comprises a curved side wall 592 which may conform to an outer contour of the cylindrical, first housing portion 502. Alternative embodiments are contemplated in which the shape and/or size of any of the housing parts and portions may vary. Furthermore, as shown in FIG. 13, the base may include at least one elastic clip 590 to secure the housing in the mounted position on the base 586. The illustration of FIG. 14 shows the housing received in and carried by the base 586, with the elastic clip 590 transversely securing the base 586. As further shown, when the housing is positioned in the base 586, the pump assembly 506 extends outward of the vertical surface (e.g., wall), and preferably opposite to the rear wall 582 and thus opposite to the vertical surface, to facilitate operation of the pump assembly 506.

Various features may be added to the housing assembly without departing from the scope of the present disclosure. For example, the housing assembly may be provided with a small access door or drainage port on the first housing portion to remove or drain any liquid that may have dripped within the container during periods of use. The exterior surfaces of the first housing portion and/or second housing portion may be decorated with patterns, designs, or graphics having a tropical theme such as bamboo, seashells, leaves, pineapples, waves, starfish and sea turtles, for example and without limitation. Other decorative themes may include country, southwestern and industrial/cityscape, for example and without limitation. In some embodiments, the graphics may be textured and carved, stamped, molded or otherwise provided in the exterior surfaces of the dispensing container. In addition, the dispensing container may be constructed from plastic, wood, or a metal material including aluminum, or any combination thereof. The first housing portion, and/or lid may be transparent or opaque.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A liquid dispensing assembly for housing an inverted container to facilitate substantially complete dispensing of a liquid substance from the inverted container, the liquid dispensing assembly comprising:

a housing, comprising:

a first housing portion and a second housing portion disconnectably mountable to one another to enclose an interior space of the housing, the interior space of the housing configured to receive the inverted container containing the liquid substance with the inverted container enclosed within the interior space by the housing, a socket arranged within the interior space of the housing, for receiving a neck of the inverted container; and a pump assembly carried by the housing, said pump assembly in fluid communication with the socket of the housing and operable from outside the housing to dispense fluid from the inverted container, through the neck of the inverted container and via a delivery aperture of the pump assembly located outside the housing; wherein the second housing portion comprises at least one spike configured to perforate the inverted container, to form at least one corresponding vent opening through the inverted container.

2. The liquid dispensing assembly of claim 1, wherein the socket is provided in the first housing portion.

3. The liquid dispensing assembly of claim 1, wherein the pump assembly is carried by the first housing portion.

4. The liquid dispensing assembly of claim 1, wherein the first housing portion comprises a pair of cutouts arranged at opposite sides of a top end of the first housing portion configured to facilitate inserting a subject's fingers therethrough to manually grasp the inverted container housed within the first housing portion.

5. The liquid dispensing assembly of claim 1, wherein the housing is at least partially see-through to enable viewing the inverted container.

6. The liquid dispensing assembly of claim 1, wherein the second housing portion is formed as a top cover mountable on the first housing portion and the at least one spike of the second housing portion is configured to perforate at least one perforable area provided on a top end of the inverted container opposite to the neck of the inverted container.

7. The liquid dispensing assembly of claim 1, wherein the socket extends downward from an internal wall of the housing and in fluid communication with an opening formed through said internal wall.

8. The liquid dispensing assembly of claim 7, wherein the internal wall provides a partition that divides the interior space of the housing into a first subspace and a second subspace, wherein the first subspace is configured to receive the inverted container, and wherein fluid communication between the pump assembly and the socket is provided through the second subspace.

9. The liquid dispensing assembly of claim 8, further comprising a delivery conduit arranged within the second subspace, wherein the delivery conduit extends from and is in fluid communication with the socket, and wherein the pump assembly extends from and is in fluid communication with the delivery conduit.

10. The liquid dispensing assembly of claim 9, wherein a first end of the delivery conduit is connected to a nipple of the socket and an opposite second end of the delivery conduit is connected to the pump assembly.

11. The liquid dispensing assembly of claim 1, further comprising a spike arranged at the socket, the spike configured to perforate a perforable membrane carried by the neck of the inverted container and establish fluid communication between the inverted container and the socket.

12. The liquid dispensing assembly of claim 11, wherein the spike comprises at least one through opening providing fluid communication between the neck of the inverted container and the pump assembly.

13. The liquid dispensing assembly of claim 1, wherein the pump assembly comprises a plunger, a flange, and a delivery spout, wherein said flange and delivery spout are located outside the housing, the delivery spout comprising the delivery aperture, and further wherein the delivery spout is operable to reciprocate the plunger to dispense a quantity of said liquid substance from the inverted container.

14. A liquid dispensing assembly for housing an inverted container to facilitate substantially complete dispensing of a liquid substance from the inverted container, the liquid dispensing assembly comprising:

a housing, comprising:

a first housing portion and a second housing portion disconnectably mountable to one another to enclose an interior space of the housing, the interior space of the housing configured to receive the inverted container containing the liquid substance, a socket provided in the first housing portion and arranged within the interior space of the housing, for receiving a neck of the inverted container; and a pump assembly carried by the first housing portion of the housing, said pump assembly in fluid communication with the socket of the housing and operable from outside the housing to dispense fluid from the inverted container, through the neck of the inverted container and via a delivery aperture of the pump assembly located outside the housing; wherein the second housing portion comprises at least one spike configured to perforate the inverted container, to form at least one corresponding vent opening through the inverted container.

15. The liquid dispensing assembly of claim 14, wherein the second housing portion is formed as a top cover mountable on the first housing portion and the at least one spike of the second housing portion is configured to perforate at least one perforable area provided on a top end of the inverted container opposite to the neck of the inverted container.

16. A liquid dispensing assembly for housing an inverted container to facilitate substantially complete dispensing of a liquid substance from the inverted container, the liquid dispensing assembly comprising:

a housing, comprising:

a first housing portion and a second housing portion disconnectably mountable to one another to enclose an interior space of the housing, the interior space of the housing configured to receive the inverted container containing the liquid substance, a socket provided in the first housing portion and arranged within the interior space of the housing, for receiving a neck of the inverted container, the socket extending downward from an internal wall formed in the first housing portion of the housing and in fluid communication with an opening formed through said internal wall;

a pump assembly carried by the first housing portion of the housing, said pump assembly in fluid communication with the socket of the housing and operable from outside the housing to dispense fluid from the inverted container, through the neck of the inverted container and via a delivery aperture of the pump assembly located outside the housing; wherein the internal wall provides a partition that divides the interior space of the housing into a first subspace and a second subspace, wherein the first subspace is configured to receive the inverted container, and wherein fluid communication between the pump assembly and the socket is provided through the second subspace; and further wherein the second housing portion comprises at least one spike configured to perforate the inverted container, to form at least one corresponding vent opening through the inverted container.

17. The liquid dispensing assembly of claim 16, wherein the second housing portion is formed as a top cover mountable on the first housing portion and the at least one spike of the second housing portion is configured to perforate at least one perforable area provided on a top end of the inverted container opposite to the neck of the inverted container.

* * * * *